US007487553B2

(12) United States Patent
Price

(10) Patent No.: US 7,487,553 B2
(45) Date of Patent: Feb. 10, 2009

(54) GLOVE

(76) Inventor: Joel Price, 106 Primrose St., Chevy Chase, MD (US) 20815

( * ) Notice: Subject to any disclaimer, the term of this patent is extended or adjusted under 35 U.S.C. 154(b) by 366 days.

(21) Appl. No.: 11/041,493

(22) Filed: Jan. 25, 2005

(65) Prior Publication Data

US 2005/0160516 A1 Jul. 28, 2005

Related U.S. Application Data

(60) Provisional application No. 60/538,514, filed on Jan. 26, 2004.

(51) Int. Cl.
*A41D 19/00* (2006.01)

(52) U.S. Cl. ..... 2/161.1

(58) Field of Classification Search ..... 2/161.1, 2/161.2, 161.3, 161.6
See application file for complete search history.

(56) References Cited

U.S. PATENT DOCUMENTS

| | | | | |
|---|---|---|---|---|
| 1,885,572 | A * | 11/1932 | Wood | 601/137 |
| 2,242,318 | A * | 5/1941 | Mosier | 2/159 |
| 2,309,710 | A | 2/1943 | Patterson, Jr. | |
| 2,559,788 | A * | 7/1951 | Patterson, Jr. | 2/161.2 |
| 2,657,391 | A | 11/1953 | Crandon | |
| 2,703,887 | A | 3/1955 | Kennedy | |
| 2,913,729 | A | 11/1959 | Wisenberg | |
| 2,949,610 | A | 8/1960 | Lutsky | |
| 3,341,861 | A | 9/1967 | Robbins | |
| 3,363,265 | A * | 1/1968 | Dummire | 2/167 |
| 3,649,967 | A | 3/1972 | Millman | |
| 4,195,365 | A * | 4/1980 | Eyman et al. | 441/57 |
| 4,316,926 | A | 2/1982 | Kaminstein | |
| 4,497,072 | A | 2/1985 | Watanabe | |
| 4,514,460 | A | 4/1985 | Johnson | |
| 5,774,895 | A * | 7/1998 | Baldwin | 2/161.1 |
| 5,794,266 | A | 8/1998 | Han | |
| 5,983,395 | A | 11/1999 | Lei | |
| 5,991,926 | A | 11/1999 | Lakusiewicz | |
| 6,041,438 | A * | 3/2000 | Kirkwood | 2/161.1 |
| 6,154,885 | A | 12/2000 | Kobayashi et al. | |
| 6,254,947 | B1 | 7/2001 | Schaller | |
| 6,408,442 | B1 | 6/2002 | Kang | |
| 6,526,593 | B2 * | 3/2003 | Sajovic | 2/161.8 |
| D478,405 | S | 8/2003 | Hatcher et al. | |
| 6,675,392 | B2 * | 1/2004 | Albert | 2/161.1 |
| 2003/0037364 | A1 | 2/2003 | Albert | |
| 2003/0051285 | A1 * | 3/2003 | Bower | 2/16 |
| 2004/0199978 | A1 * | 10/2004 | Cass | 2/161.3 |

* cited by examiner

*Primary Examiner*—Katherine Moran
(74) *Attorney, Agent, or Firm*—Greenblum & Bernstein, P.L.C.

(57) ABSTRACT

A glove has a glove body including a front portion defining a palm area and a rear portion. A plurality of independent tubular members extends from the palm area and inter-dispersed apertures are dispersed on the front portion, including the palm area and the plurality of independent tubular members to maximize the tactile sensation of a user. The inter-dispersed apertures are of various sizes.

16 Claims, 3 Drawing Sheets

GLOVE

CROSS REFERENCE TO RELATED APPLICATIONS

This application claims priority to U.S. provisional application No. 60/538,514, filed on Jan. 26, 2004, which is incorporated herein by reference in its entirety.

FIELD OF THE INVENTION

The invention generally relates to a glove and, more particularly, to a conformal grip glove which increases tactile sensitivity of the user, in addition to increasing ventilation.

BACKGROUND DESCRIPTION

Individuals participating in strenuous sport or work activities all have a common problem, i.e., the degrading ability to grip objects as their hands perspire or become wet. Most choose to address the problem by wearing one of the numerous hand gloves available on the market. However, in all the textured gloves available today, the wearer in varying degrees sacrifices overall hand dexterity and tactile sensitivity for improved grip—especially when wet.

More specifically, conventional gloves are designed to withstand the rigors of extended work or play. In making them more durable, the materials inherently sacrifice both manual dexterity and tactile sensitivity to achieve the desired grip improvement. These conventional type gloves also do not tend to freely permit the escape of moisture and heat, thereby increasing overall perspiration that leads to even further loss of grip. These conventional types of gloves additionally sacrifice the maximization of overall handgrip and tactile sensitivity because they must incorporate thicker, more durable materials that will last repeatedly over time.

SUMMARY OF THE INVENTION

In a first aspect of the invention, a glove comprises a glove body including a front portion defining a palm area and a rear portion. A plurality of independent tubular members extends from the palm area and inter-dispersed apertures are dispersed on the front portion, including the palm area and the plurality of independent tubular members to maximize a tactile sensation of a user. The inter-dispersed apertures are of various sizes.

In another aspect of the invention, the glove includes a front portion defining a palm area, a rear portion and a plurality of independent tubular members extending from the palm area. Inter-dispersed apertures are provided on the palm area and the plurality of independent tubular members to maximize the tactile sensation, increase flexibility and conformity to a user's hand. The inter-dispersed apertures are each substantially circular shaped possessing inherent roll over capabilities while eliminating stress points.

In yet another aspect of the invention, the glove includes a front portion defining a palm area, a rear portion, and a plurality of independent tubular members extending from the palm area. A plurality of inter-dispersed apertures is provided on the plurality of independent tubular members, portions of the palm area and the rear portion. A textured, high friction external layer and/or grip pattern is provided on at least the palm area and/or the plurality of independent tubular members. An internal flock lining is provided on an underside of the external layer and material is provided on portions of the palm area, between two of the independent tubular members, and leading to the rear portion.

DETAILED DESCRIPTION OF EMBODIMENTS OF THE INVENTION

The invention is directed to a reusable or disposable glove which increases tactile sensation of the user, in addition to increasing ventilation. The glove of the invention can be worn when both improved grip and tactile sensitivity are of utmost importance. In one aspect of the invention, an open-mesh pattern design and perspiration wicking internal lining material of the gloves conform snugly to each individual hand providing a breathable textured surface. The gloves may be dip molded, for example, and the hole pattern may be produced using electric hot punches. The gloves may also be manufactured in multiple pre-formed sizes.

In implementation, the glove of the invention addresses the following desirable features.

Increases Overall Handgrip

In one aspect of the invention, the glove features a slightly raised pattern of high friction polymer material that conforms directly to the hand providing greater friction than perspiring skin, as well as permitting natural hand closure. Additional friction forces are created when the multiple exposed edges of holes roll ever slightly upon themselves upon extreme shear situations.

Maintains Manual Dexterity

The glove provides natural unrestrictive motion of the palm, fingers and thumb. The glove design may incorporate polymer materials with high elongation properties to conform to each individual hand so as to offer a good hand fit with normal blood circulation throughout strenuous activities. In addition, the holes are located to eliminate or minimize material in areas where natural hand motion could be restricted, such as knuckles and creases.

Maintains Tactile Sensitivity

Although nothing is quite as sensitive as all the nerves in the natural dry skin of a bare hand, the glove maximizes the percentage of skin contact to maintain overall tactile sensitivity. The skin in some regions actually protrudes beyond the outer surface of the glove material. The glove, in one aspect of the invention, additionally includes a seamless, conformal open-mesh design. The open-mesh design freely allows the perspiration to either be absorbed by the internal fiber lining and wicked away or evaporated quickly away from the skin surface. All of those factors help the user maintain drier hands and excellent tactile sensitivity.

Glove of the Invention

Figure 1B:
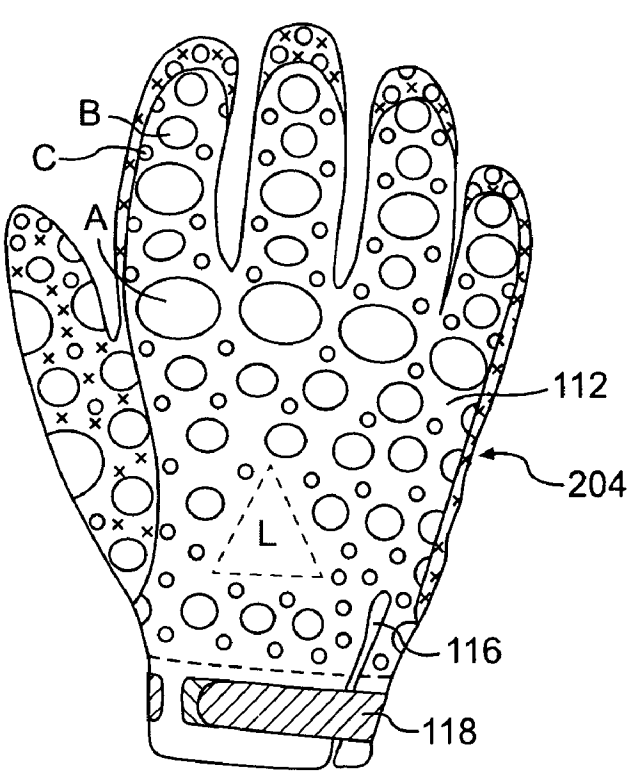
FIGS. 1*a* and 1*b* show a front and rear view of one embodiment of a glove in accordance with the invention.
Figure 1A:
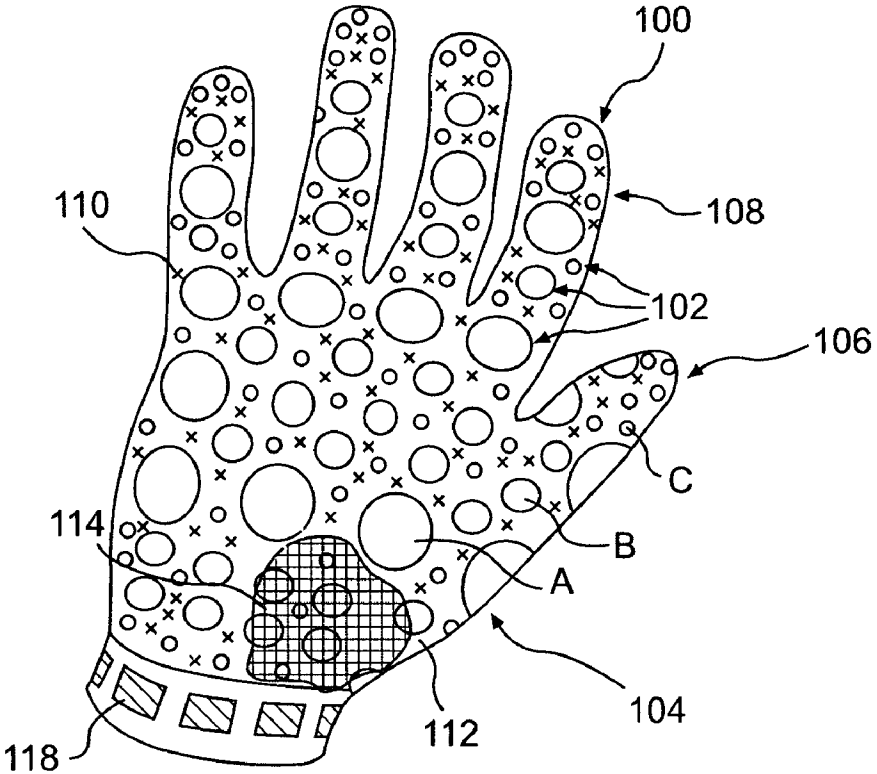

FIGS. 1*a* and 1*b* show a front and rear view of one embodiment of the glove in accordance with the invention. The glove is generally depicted as reference numeral 100 and includes an open mesh hole pattern 102. In one embodiment, the open mesh hole pattern 102 may be a combination of first size holes "A", second size holes "B", and third size holes "C", on both a palm side 104 and a rear side 204 of the glove 100. The holes should be sized and placed in such a manner that a user's fingers will not easily pass through when wearing the glove 100. In one embodiment, the first size holes "A" may range from approximately 0.50 to 0.75 inches in diameter, the second size holes "B" may range from approximately 0.25 to 0.50 inches in diameter and third size holes "C" may range from approximately 0.12 to 0.25 inches in diameter. The smaller sized holes "C" may be used as ventilation holes. The open mesh hole pattern 102, whether it be a combination of the various sized holes or uniform holes, provides for maximum skin exposure of approximately 60-75%. The open mesh hole pattern 102, again whether a combination of hole sizes or uniform hole sizes, may additionally attribute to hand conformity.

Still referring to FIGS. 1*a* and 1*b*, the shape of the holes are preferably circular; however, other shapes such as square, polygonal or oval and the like are contemplated by the invention. The circular shape, though, has been found to allow the glove 100 to conform, flatly, to the complex shape of a user's hand. The circular shape also provides improved roll over capabilities (compared to other shapes), which improves gripping capabilities of the user. In addition, a circular shape minimizes tear points, e.g., does not possess stress points at corners.

The glove 100 is also preferably fully anatomical, i.e., opposing thumb 106 and curved fingers 108, each independent and attached to one another, for maximum comfort and reduced hand strain. The glove 100 may additionally include a textured grip pattern and/or high friction material (from a second dip process) designated as "X", on the opposing thumb 106, the palm area 110 and palm side of the curved fingers 108, in addition to a slight overlap onto a rear portion of the curved fingers 108 (see FIG. 1*b*). Alternatively, the textured grip pattern may be at any other combination of locations such as, for example, the fingers only. A straight cuff is preferred, although other cuffs are also contemplated by the invention.

In one aspect of the invention, the textured grip pattern or high friction material "X" is a Neoprene or custom outer surface with high tackiness, especially in wet conditions.

This outer surface may be dipped onto the glove in order to provide such surface on the entire or substantially entire palm side, with a slight overlap on the fingers 108 on the rear side 204 of the glove 100. This process may also result in the thumb 106 being covered by the material "X". Also, the dip process may be an entire dip over an entire natural rubber layer, forming a layer over the entire glove. The outer surface may be used in combination with the textured pattern, or alone.

As in all embodiments described herein, a base layer 112 may be provided under the textured grip pattern or high friction material "X". In the embodiments of FIGS. 1*a* and 1*b*, the base layer 112 is exposed on substantially the entire rear side of the glove, except for the thumb area 106 and the overlap area on the remaining fingers 108 (which are provided with the textured grip pattern or high friction material "X"). The base layer 112 may be a natural rubber or other known materials, providing increased overall strength and elongation of the glove 100. The glove 100 may have an additional internal flock lining 114 such as, for example, 100% Rayon (or Cotton) for ease of donning, overall comfort and natural wicking of hand perspiration.

The overall thickness of the glove 100 in the palm and finger regions is approximately, in one aspect of the invention, 22-28 millimeters (e.g., 0.022 to 0.028 gauge) in order to provide increased conformity and flexibility. The glove 100 may additionally include a slit 116 and fastening latch 118 such as Velcro™, for example, for ease of donning and fastening to the user's hand, respectively. A logo "L" may be sewn, bonded or molded to a rear side of the glove.

Figure 2B:
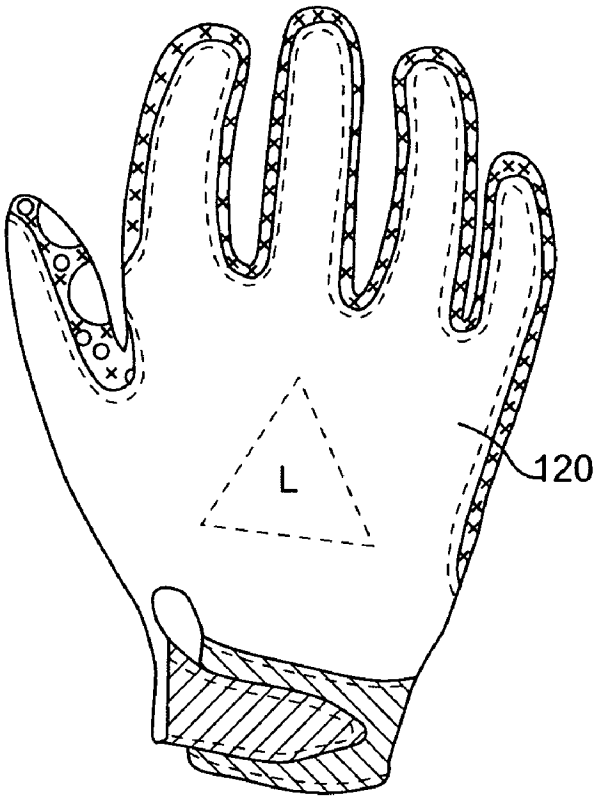
FIGS. 2*a* and 2*b* show a front and rear view of one embodiment of the glove in accordance with the invention.
Figure 2A:
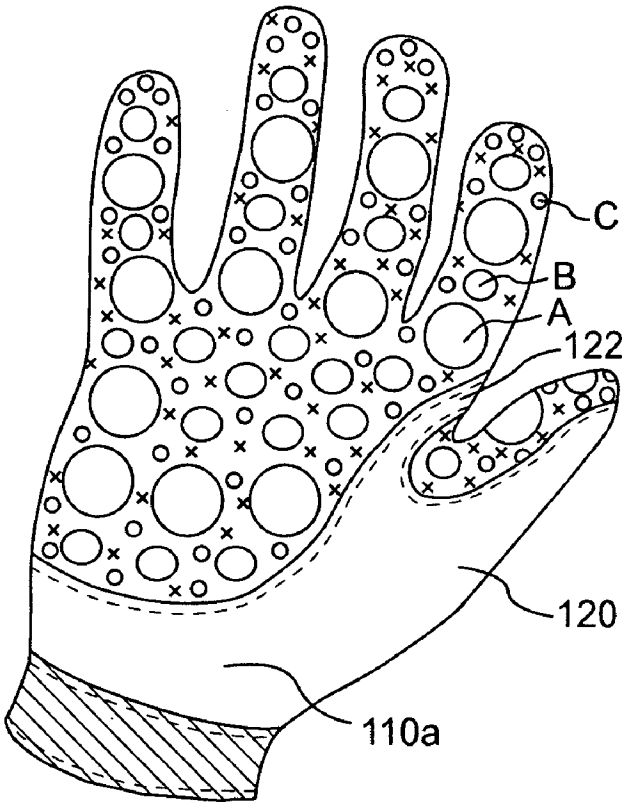

FIGS. 2*a* and 2*b* show an embodiment of the invention having an outermost flexible, breathable material 120 sewn or bonded to the outermost layer of the glove 100, whether it is the layer "X" or the base layer 112. In the embodiment of FIGS. 2*a* and 2*b*, the material 120 may be leather or fabric, for example, which is placed across a lower portion 110*a* of the palm 100, in addition to portions of the thumb 106 and substantially the entire rear portion 204 of the glove. The additional material 120 may also wrap from the palm area 110*a*, between the thumb 106 and adjacent finger 108, to the rear side 204 of the glove. The material 120 may be used to increase the durability of the glove, and may also cover portions of the hole pattern 102. The material 120, in certain regions of the glove, may be used for added hand protection, and to increase the durability of the glove such as the area between the thumb and remaining fingers.

The material 120 may form a seam 122 which provides additional flexibility and conformal fit to the user. This embodiment also includes the slit 116 and fastening latch 118 for ease of donning and fastening to the user's hand, respectively. A logo "L" may be sewn, bonded or molded to the rear side of the glove on the material 120. Additionally, in the embodiment of FIGS. 2*a* and 2*b*, the glove 100 may include the textured grip pattern or high friction material (from a second dip process) designated as "X", on the opposing thumb 106 and palm side of the curved fingers 108.

Figure 3B:
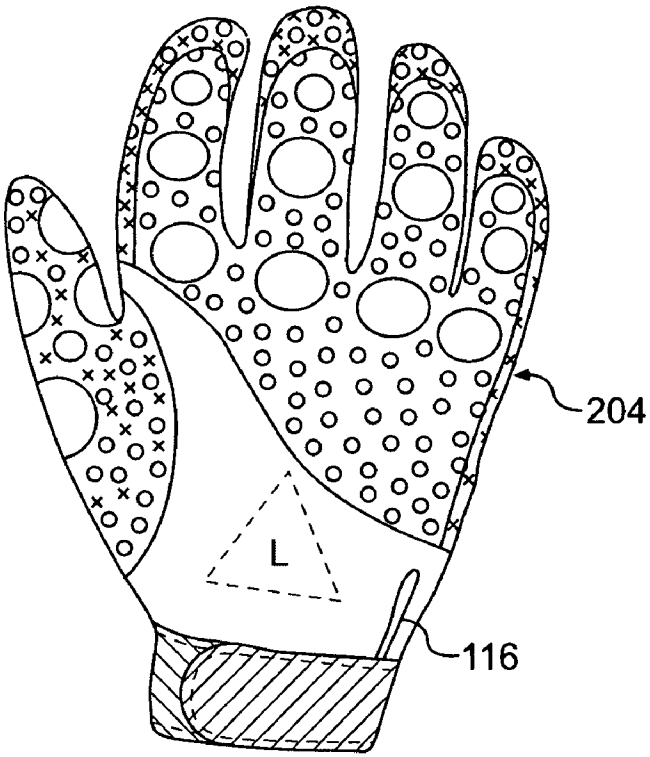
FIGS. 3*a* and 3*b* show a front and rear view of one embodiment of the glove in accordance with the invention.
Figure 3A:
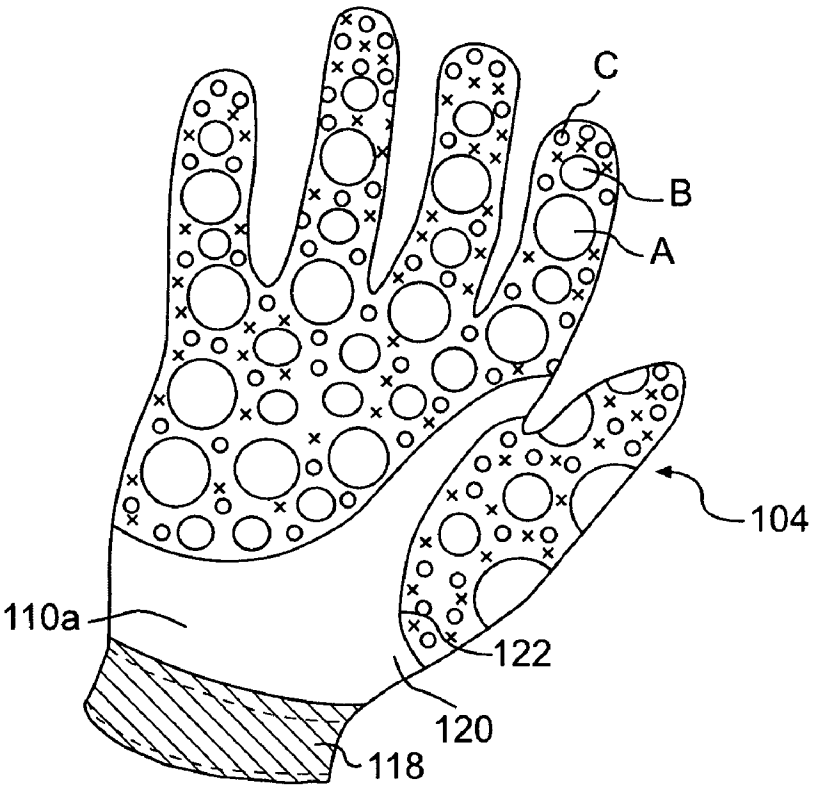

FIGS. 3*a* and 3*b* show another embodiment of the invention. In this embodiment, only a portion of the rear side 204 of the glove 100 and a portion of the palm side 104 of the glove 100 has the additional material 120. The additional material 120 also wraps from the palm area 110*a*, between the thumb 106 and adjacent finger 108 (e.g., index finger) to the rear side 204 of the glove. The palm side 104 and the fingers 106 and 108 also include the textured grip pattern or high friction material "X". The rear side 204 of the glove 100 includes mainly smaller sized holes "C", acting as ventilation holes. The rear side 204 of the glove 100 may also include larger sized holes "A", strategically placed at a location of the user's knuckles. The holes "A" will allow for increased flexibility of the glove 100 and hence greater flexibility of the user's hand. The "B" sized holes preferably are not located on the rear side 104; although a few of these sized holes may be provided.

Similar to the embodiment of FIGS. 2*a* and 2*b*, the material 120 may be used to increase the durability of the glove. The material 120 may also cover portions of the hole pattern 102 and, in certain regions, may be used for added hand protection. The material 120 may also form a seam 122 which provides additional flexibility and conformal fit to the user. This embodiment also includes the slit 116 and fastening latch 118 for ease of donning and fastening to the user's hand, respectively. A logo "L" may be sewn, bonded or molded to a rear side of the glove on the material 120.

Additionally, similar to FIGS. 1*a* and 1*b*, the base layer 112 may be provided under the textured grip pattern or high friction material "X". The base layer 112 is exposed on substantially the entire rear side of the glove, except for the thumb area 106 and the overlap area on the remaining fingers which are provided with the textured grip pattern or high friction material "X". The material 120, on the rear side 204 of the glove, will also cover the base layer 112.

While the invention has been described in terms of embodiments, those skilled in the art will recognize that the invention can be practiced with modification within the spirit and scope of the appended claims.

It is claimed:

1. A glove comprising a glove body including a front portion defining a palm area including a central portion and a perimeter portion and a rear portion, a plurality of independently extending tubular members extending from the palm area, and a plurality of inter-dispersed apertures dispersed through the front portion, including the palm area, and the plurality of independent tubular members to maximize a tactile sensation of a user, the plurality of inter-dispersed apertures being of various sizes disposed in at least the central portion of the palm area with material inter-dispersed therethrough, a high friction external textured grip layer formed on the palm area and the plurality of independent tubular members, a base layer exposed on the rear portion, an internal flock lining covering the base layer, and material placed on a lower portion of the palm area, an area of the rear portion and between the lower portion and the area, wherein the high friction external textured grip layer is provided over the base layer on the palm area and the plurality of independent tubular members and overlapping onto the rear portion of the plurality of independent tubular members and an overall thickness of the glove in the palm and the independently extending tubular members is approximately 22-28 millimeters.

2. The glove of claim 1, wherein the plurality of inter-dispersed apertures include first sized holes, second sized holes and third sized holes.

3. The glove of claim 1, wherein the plurality of inter-dispersed apertures are sized and placed such that a user's fingers will not easily pass through after donning.

4. The glove of claim 1, wherein the inter-dispersed apertures are located on the rear portion corresponding to knuckles of the user.

5. The glove of claim 1, wherein: each of the plurality of inter-dispersed apertures is circular shaped; and the plurality of inter-dispersed apertures possess roll over capabilities while eliminating stress points.

6. The glove of claim 1, wherein the material is placed on a substantial portion of the rear portion including a rear side of the tubular members.

7. The glove of claim 6, wherein the material is placed over the high friction external textured grip layer on the palm area and further forms a seam to increase flexibility when using the material.

8. The glove of claim 7, wherein the plurality of inter-dispersed apertures provides for skin exposure of approximately 60-75%.

9. The glove of claim 1, wherein the plurality of inter-dispersed apertures are a first sized hole and a second sized hole on the palm area.

10. A glove comprising a front portion defining a palm area, a rear portion, a plurality of independent tubular members extending from the palm area which includes a central portion and a perimeter portion, and a plurality of inter-dispersed apertures provided through at least the central portion the palm area and the plurality of independent tubular members to maximize tactile sensation, increase flexibility and conformity to a user's hand, the plurality of inter-dispersed apertures are each substantially circular shaped configured to possess roll over capabilities while eliminating stress points; and further comprising:

a base layer;

a textured, high friction external layer formed on the base layer on at least the palm area and the plurality of independent tubular members; and an internal flock lining covering the base layer, wherein an overall thickness of the glove in the palm area and the plurality of independent tubular members is approximately 22-28 millimeters.

11. The glove of claim 10, wherein: the plurality of inter-dispersed apertures includes first sized holes, second sized holes and third sized holes; each of the plurality of inter-dispersed apertures is sized and placed in such a manner that a user's fingers will not pass through any of the plurality of inter-dispersed apertures after donning; and the plurality of inter-dispersed apertures provides for skin exposure of approximately 60-75%.

12. The glove of claim 10, wherein the base layer is exposed on the rear portion.

13. The glove of claim 10, further comprising material placed between two of the plurality of independent tubular members, a portion of the palm area and a portion of the rear portion.

14. The glove of claim 10, wherein the plurality of inter-dispersed apertures are of various sizes.

15. The glove of claim 10, wherein:

the plurality of inter-dispersed apertures are of various sizes;

the various sizes include at least one of a first size with a range from approximately 0.50 to 0.75 inches in diameter and a second size with a range from approximately 0.25 to 0.50 inches in diameter.

16. A glove comprising: a front portion defining a palm area; a rear portion; a plurality of independent tubular members extending from the palm area; a plurality of inter-dispersed apertures of various sizes provided through the plurality of independent tubular members, portions of the palm area and the rear portion; at least one of textured, high friction external layer and a grip pattern on the palm area and the plurality of independent tubular members; an internal flock lining provided on an underside of the external layer; and material on a portion of the palm area of the glove and between two of the independent tubular members, leading to the rear portion, wherein the plurality of inter-dispersed apertures provides for skin exposure of approximately 60-75%.

* * * * *